US005548295A

United States Patent [19]

Lo Forti et al.

[11] Patent Number: 5,548,295

[45] Date of Patent: Aug. 20, 1996

[54] MULTISHAPED BEAM DIRECT RADIATING ARRAY ANTENNA

[75] Inventors: Raimondo Lo Forti, Guidonia; Marco Lisi, Rome, both of Italy

[73] Assignees: Space Engineering Spa, Rome, Italy; Alenia Spazio Spa, L'Aquilla, Italy

[21] Appl. No.: 396,201

[22] Filed: Feb. 28, 1995

[51] Int. Cl.[6] ..... H01Q 3/22; H01Q 3/24; H01Q 3/26

[52] U.S. Cl. ..... 342/373

[58] Field of Search ..... 342/373

[56] References Cited

U.S. PATENT DOCUMENTS

| | | | |
|---|---|---|---|
| 4,633,259 | 12/1986 | Hrycak | 342/373 |
| 5,151,706 | 9/1992 | Roederer et al. | 342/373 |
| 5,373,299 | 12/1994 | Ozaki et al. | 342/373 |

FOREIGN PATENT DOCUMENTS

| | | |
|---|---|---|
| 0405372 | 1/1991 | European Pat. Off. . |
| 0420739 | 4/1991 | European Pat. Off. . |
| 0497652 | 8/1992 | European Pat. Off. . |

*Primary Examiner*—Theodore M. Blum
*Attorney, Agent, or Firm*—Herbert Dubno

[57] ABSTRACT

A multishaped beam direct radiating array antenna has a network on which high power beam forming sub-networks are disposed. The network is interposed between radiating elements and RF power amplifiers. This antenna is in addition constituted with a traditional network in which power combiners, phase shifters and inter-connection lines are provided. The most significant feature is that, with the help of the high power beam forming network, the correct amplitude and phase values, at the radiating element level, may be achieved without differentiating the RF power amplifier output levels, thus keeping its efficiency as high as possible. One of the advantages this configuration presents is the possibility to utilize only one antenna in comparison of the previous techniques in which the same results were obtained utilizing many radiating panels.

1 Claim, 4 Drawing Sheets

MULTISHAPED BEAM DIRECT RADIATING ARRAY ANTENNA

FIELD OF THE INVENTION

The present invention relates to a substantial improvement in the design and implementation of antennas, specially multibeam antennas. The multibeam radiating antenna of the invention is a direct radiating antenna, in which the beam shaping is achieved by controlling the field distribution at the radiating element level through the signal phase only at the input of the RF power amplifiers. This optimizes the RF working point of the RF power amplifiers, assuring consequently a maximum efficiency.

BACKGROUND OF THE INVENTION

As people skilled in the art know, a multibeam antenna is the one which produces a certain number of beams at the same time. Particularly, in the case of the antenna of the invention, the shape of each beam could be different from the others. The multibeam antenna can also be an antenna with a direct feeding, so that the radiating elements emit directly into the space.

SUMMARY OF THE INVENTION

According to the invention the multibeam direct radiating array antenna has a passive network allocated between radiating elements and power amplifiers and a conventional network. The passive network can be realized by a number of beam-forming sub-networks of high power where the input signals and output signals pass through a series of hybrids and phase shifters suitably allocated. For the conventional network there are: dividers; phase shifters and; power combiners; which are connected through connection lines through connection lines to the passive network.

The signal related to $i^{th}$ beam is first divided into n signals which are shifted before being routed to feed to RF power amplifiers and the amplifiers are connected in turn to the passive network realized by hybrids and fixed phase shifters appropriately connected. The multishaped beam direct radiating array antenna according to the invention is suitable for successful application particularly in the telecommunications field, especially for satellite communication and radar in the military or civilian sphere.

As it will be seen later, the present assembly of the radiating elements and beam forming network grants a remarkable advantage in the implementation and improvement of reliability vis-a-vis previous techniques.

The most significant features of the invention are essentially:

structural simplicity;

the set of the radiating elements and beams forming network.

Relating to the structural simplicity, note FIGS. 3 and 4 which diagram previous antenna systems used in space communication. It can be noted that the multishaped beam antenna, in its entirety, needs more radiating panels to obtain analogous outcomes, while the antenna of the present invention, can be formed even by a single panel. Because of the structural simplicity the antenna is reliable, being constituted by a reduced number of elements and its construction easier.

By contrast, with reference to FIG. 1 it can be noted that there are radiating elements 1 and that the power amplifiers 4 are positioned outside of the network 2. Inside the network 2 there are hybrids 7, phase shifters 8 and connection lines 12 and 13. This network 2 is therefore connected, through the connection lines, to the other network 9 which is, this time, a conventional network consisting of a series of power dividers 10, phase shifters 6, power combiners 5 and interconnection lines.

What is obtained, with this configuration, in comparison with previous techniques, is the possibility of addressing power to the radiating elements in the "appropriate mode". The expression "appropriate mode" means the distribution of the power to radiating elements to obtain, as a consequence, a good shaping of the antenna beams. This is obtained by interposing the static high power passive network and in high power, as already said before, from a bank of amplifiers 4 all fed at the same level.

To be more precise, the problem that we intend to solve with the present invention is the following: to permit different amplitudes of the signals fed to the radiating elements according to the beam to be shaped, while keeping the same RF working point for all the power amplifiers and leaving, at the same time, the phase of the radiating elements, as free as possible. This is a very important feature of the Direct Radiating Array of which electrical performance strongly depends on the phase of the radiating elements.

Having the same RF working point for all the power amplifiers, permits to these devices to operate at maximum efficiency.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
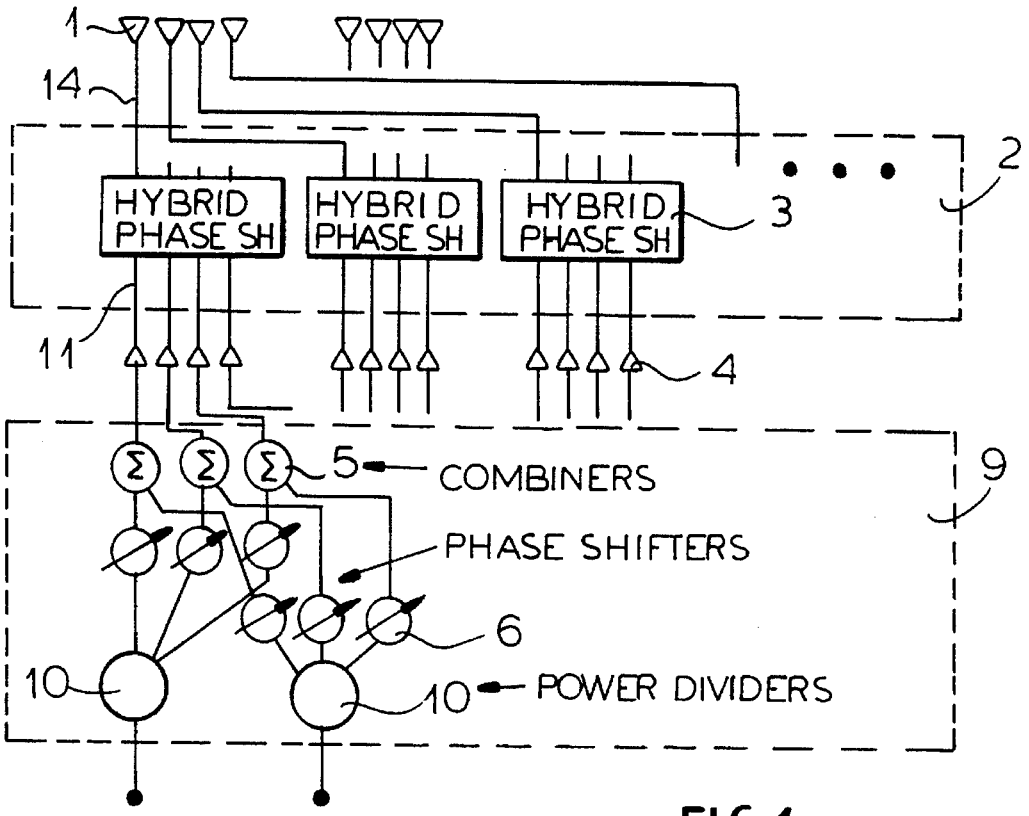
FIG. 1 is a block diagram of a multishaped beam direct radiating array antenna according to the present invention.

As can be seen from FIG. 1, the array of radiating elements 1 of the antenna has the individual elements thereof connected to outputs of the hybrid/phase shifter circuits 3 making up the network 2 which is original in this application and is provided between the usual power dividing network 9 and the antenna elements 1. The conventional network 9 has power combiners 5 supplying the respective power amplifiers 4 which are connected by the lines 11 with the hybrid/phase shifter circuits 3. The combiners 5 combine outputs of two phase shifters 6 of different power dividers 10 in the conventional network 9.

Figure 2:
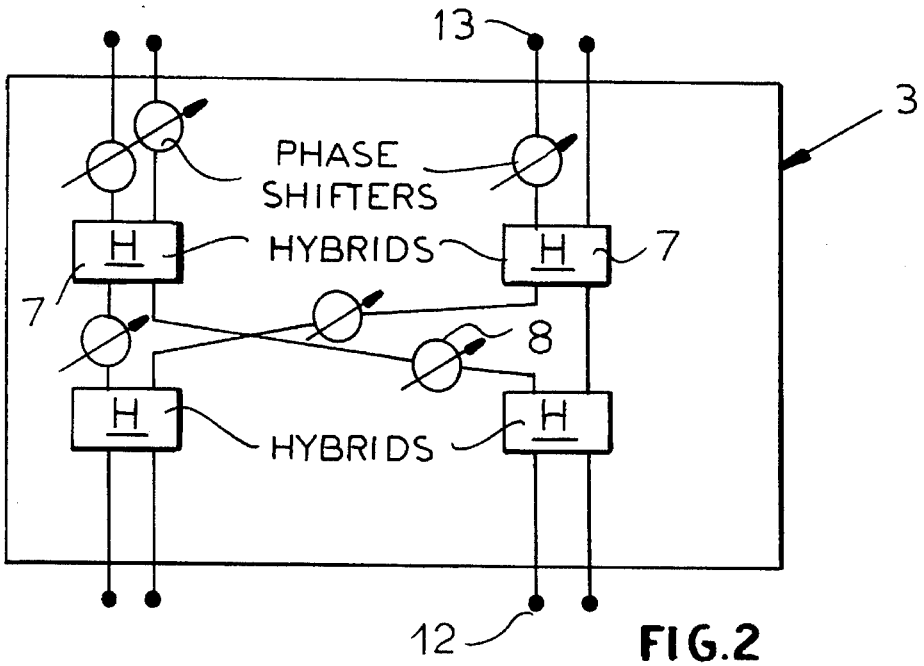
FIG. 2 is a diagram of block 3 in FIG. 1.

From FIG. 2 it will be apparent that each of the circuits 3 comprises hybrids 7 receiving inputs from connection lines 12 which may be supplied via lines 11 from the power amplifiers. The hybrids are connected by phase shifters 8 to the output hybrids 7 which feed into other power shifters outputting at terminals 13 to the lines 14 directly connected to the radiating elements 1.

Figure 3:
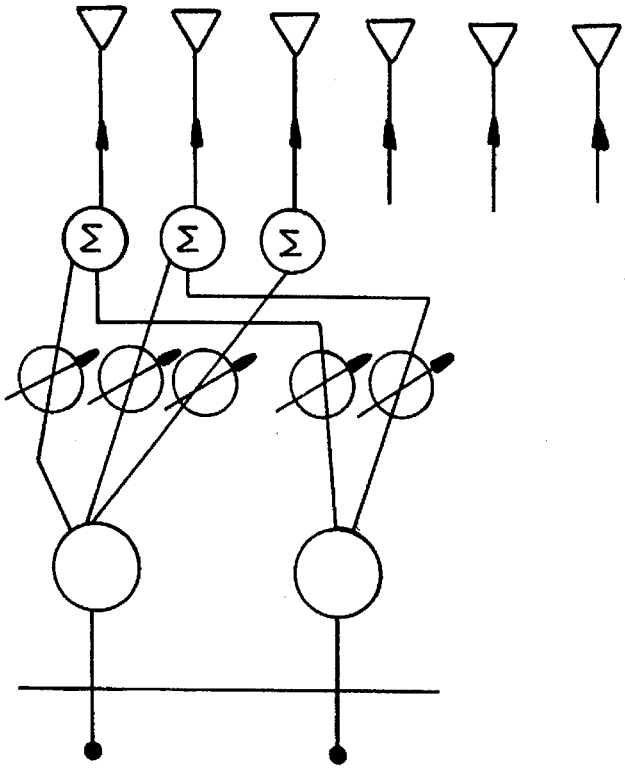
FIG.3 PRIOR ART
FIGS. 3 and 4 are diagrams showing previous techniques for; comparison with the antenna of the present application.

FIG. 3 shows refers to a solution of a traditional antenna. It is easy to observe that the elements do not include a network like that indicated at 2 in FIG. 1.

Figure 4:
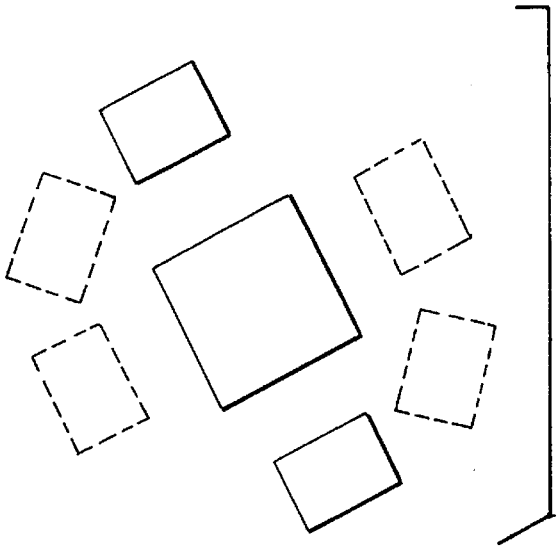
FIG.4 PRIOR ART
Figure 5A:
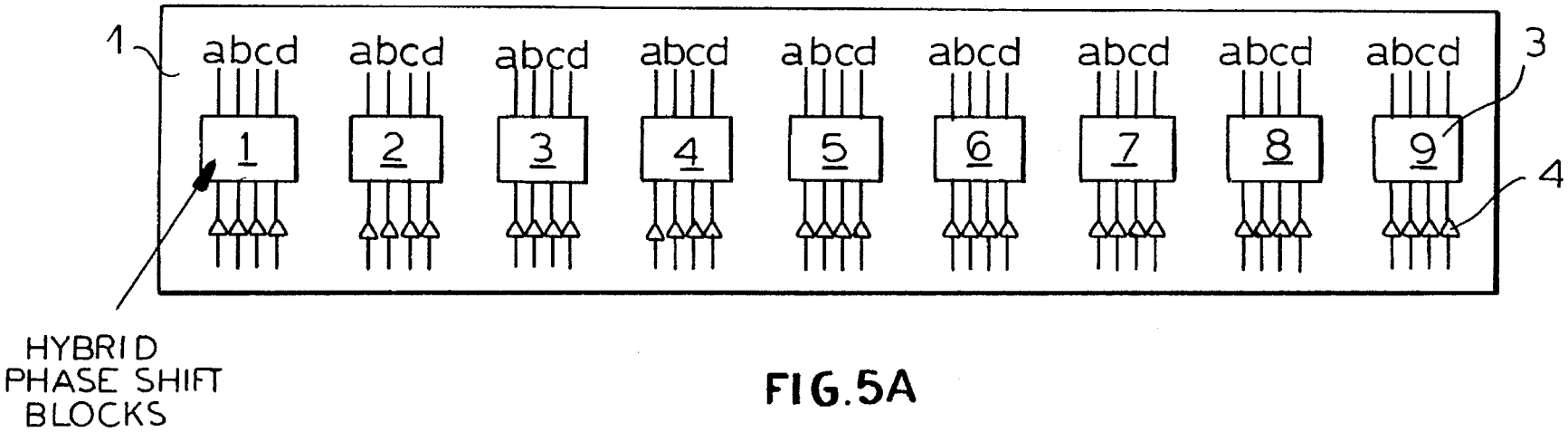
FIGS. 5A and 5B are diagrams showing schematic of a possible implementation of a multishaped antenna beam, constituted with nine subnetworks 3 of the type described in FIG. 2 (beam forming network in high power), each subnetwork having four power amplifiers and four radiators.
Figure 5B:
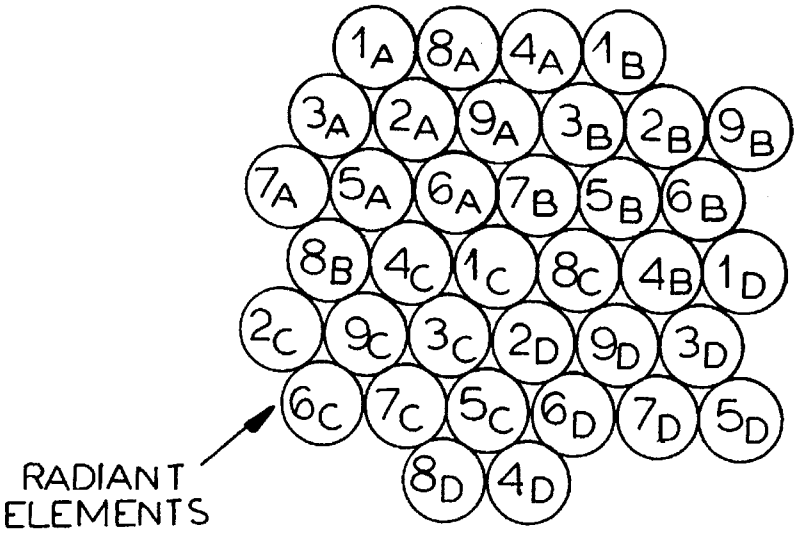
Figure 6A:
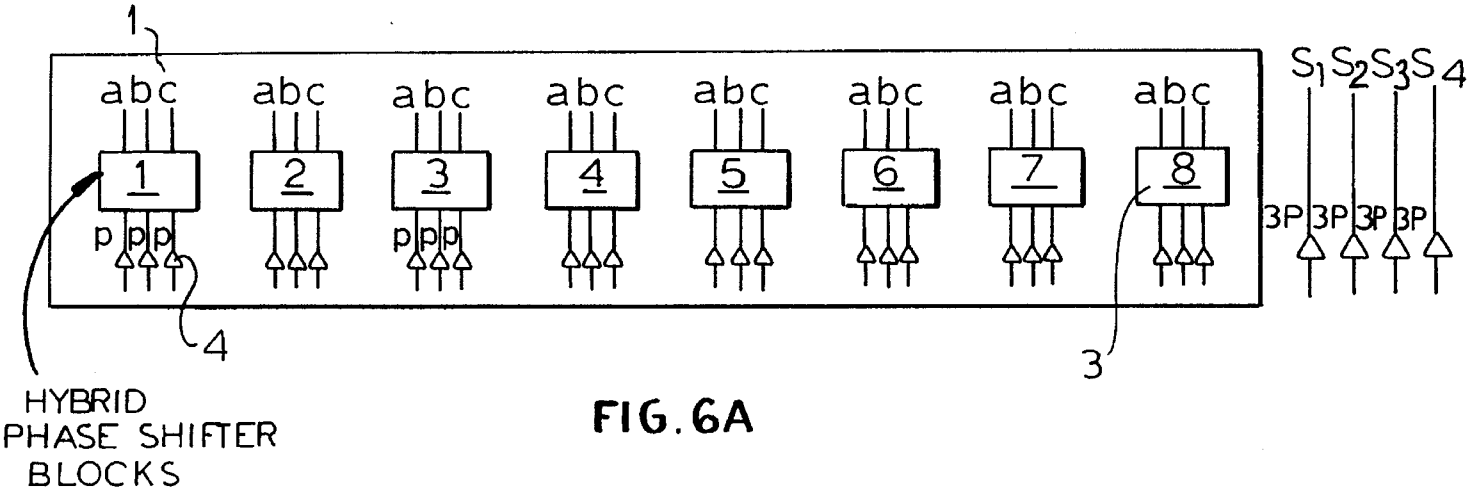
FIGS. 6A and 6B are diagrams. Schematics of a possible realisation of a multibeam antenna constituted with networks 3, having each three power amplifiers and three radiators.
Figure 6B:
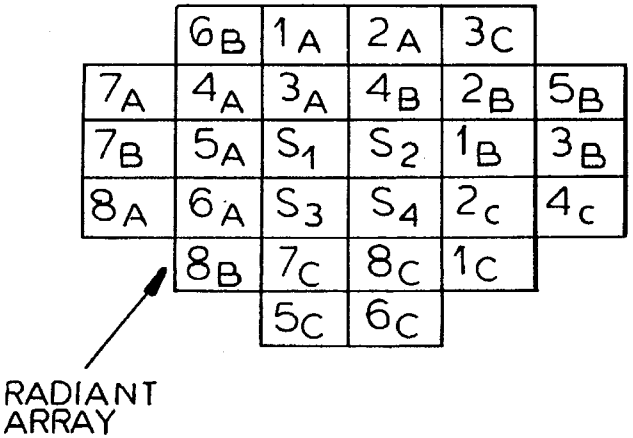

Even in FIG. 4 there is an example of antenna with a certain number of radiant elements which would be useless in the antenna of the application. An illustrative and not limitative example of the functioning of the now antenna is described below:

The signal, relative to the $i^h$ beam is initially divided in n equal signals which are shifted before feeding RF power amplifiers 4 by the phase shifters 6. Amplifiers 4, are connected to the passive network 2 constituted by hybrids 7 and phase shifters 8 connected in an appropriate mode. The expression "appropriate mode" means that the connection 11, inside at the network 2 and between network 2 and radiating elements 1, can apply appropriate topological rules.

Naturally, the beam forming network in high power configuration will be consequently chosen.

The outputs of this network 13 are directly connected to radiant elements 1 through connection lines 14. Through a traditional network 9 every beam feeds the same bank of amplifiers 4 by signals of the same amplitude and different phase. With this system, signals coming out from network 2 can have of different value according to beams shaping requirements. This means that amplitude and phase values of the radiant elements input, relative to any beam, will be the most suitable to shape the beam itself.

We claim:

1. A multibeam direct radiating array antenna for outputting a multiplicity of differently-shaped beams, comprising:

an array of radiating elements;

a passive network connected to said array and comprising a plurality of hybrid/phase shifter circuits having respective outputs each connected to a respective radiating element, each of said hybrid/phase shifter circuits comprising input terminals, first hybrids connected to said input terminals in pairs, phase shifters connected to outputs of said first hybrids, second hybrids connected to said phase shifters and to the first hybrids, and further phase shifters connected to said second hybrids and providing, along with a direct connection from one of said second hybrids, said outputs connected to the respective radiating elements;

a respective power amplifier connected to each of said input terminals, all of said power amplifiers being operated with the same radio frequency power amplitude; and a feed network supplying said amplifier, said feed network comprising a plurality of power dividers, respective phase shifters connected to each of a multiplicity of outputs of each of said power dividers and connected in groups to respective power combiners, each of said power combiners being connected to a respective one of said power amplifiers for energizing same.

* * * * *